US010513826B2

(12) United States Patent
Latendorf et al.

(10) Patent No.: US 10,513,826 B2
(45) Date of Patent: Dec. 24, 2019

(54) METHOD AND DEVICE FOR MAKING WET LAID NON WOVENS

(71) Applicant: Andritz Küsters GmbH, Krefeld (DE)

(72) Inventors: Dennis Latendorf, Krefeld (DE); Andreas Pesch, Krefeld (DE); Florian Diederich, Meerbusch (DE)

(73) Assignee: Andritz Küsters GmbH, Krefeld (DE)

( * ) Notice: Subject to any disclaimer, the term of this patent is extended or adjusted under 35 U.S.C. 154(b) by 108 days.

(21) Appl. No.: 15/547,031

(22) PCT Filed: Jan. 27, 2016

(86) PCT No.: PCT/EP2016/000138
§ 371 (c)(1),
(2) Date: Jul. 27, 2017

(87) PCT Pub. No.: WO2016/120014
PCT Pub. Date: Aug. 4, 2016

(65) Prior Publication Data

US 2018/0002866 A1 Jan. 4, 2018

(30) Foreign Application Priority Data

Jan. 28, 2015 (DE) ..... 10 2015 001 008

(51) Int. Cl.
*D21F 2/00* (2006.01)
*D21G 9/00* (2006.01)
(Continued)

(52) U.S. Cl.
CPC ..... *D21F 2/00* (2013.01); *D04H 1/732* (2013.01); *D21F 1/48* (2013.01); *D21G 9/0063* (2013.01)

(58) Field of Classification Search
CPC ..... D21G 9/0063; D21G 9/00; D21F 2/00; D21F 5/042; D21F 1/42; D21F 1/48;
(Continued)

(56) References Cited

U.S. PATENT DOCUMENTS 2,718,825 A * 9/1955 Goodwillie ..... D21F 2/00 162/306
3,320,119 A * 5/1967 Erbach ..... D21F 2/00 162/306
(Continued)

FOREIGN PATENT DOCUMENTS

CN 101925702 A 12/2010
DE 2437611 A1 2/1976
(Continued)

OTHER PUBLICATIONS

International Search Report published with PCT/EP2016/000138, dated Aug. 4, 2016, 2 pages.
(Continued)

*Primary Examiner* — Jose A Fortuna
(74) *Attorney, Agent, or Firm* — Kilpatrick Townsend & Stockton LLP

(57) ABSTRACT

Method for producing wet-laid non-woven fabrics, with which an aqueous suspension comprising fibres is laid down on a screen and is dewatered using suction boxes under the screen to form a sheet of non-woven web which is removed from the screen and guided to at least one subsequent treatment unit before the non-woven web can be wound, and transferring of the non-woven web from the screen to the at least one subsequent treatment unit and/or transferring of the non-woven web to interfaces between treatment units on the start of production and/or after an interruption in production, using a web feed, wherein web is fed via a temporarily closed draw of a free draw between the screen and the at least one subsequent treatment unit and/or of a free draw at
(Continued)

Figure 1A:
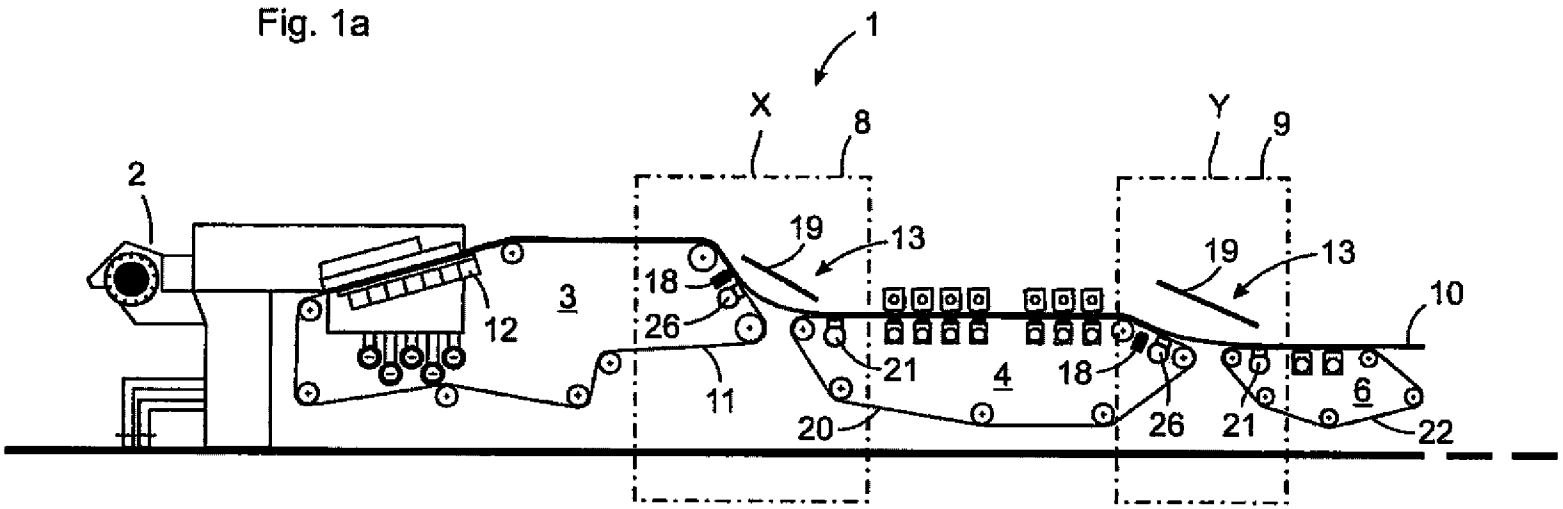

an interface between treatment units, and the respective temporarily closed draw is produced via air flows, which lift off an end feeding strip as part of the running non-woven web by blowing, adhere same to a transport path device by generating negative pressure and lift up same at the following treatment unit by suction.

5 Claims, 5 Drawing Sheets

(51) Int. Cl.
*D21F 1/48* (2006.01)
*D04H 1/732* (2012.01)

(58) Field of Classification Search
CPC . D21F 3/10; B65H 2801/84; B65H 2301/522; B65H 20/14; B65H 23/24; B65H 23/26; B65H 2301/41898; B65H 20/12; B65H 2406/112; B65H 2406/323; B41F 13/03; D04H 1/732; Y10T 83/0591; Y10T 83/364; F26B 13/104
See application file for complete search history.

(56) References Cited

U.S. PATENT DOCUMENTS 3,351,521 A * 11/1967 Murray ..... D21F 2/00 162/307
3,355,349 A * 11/1967 Devlin ..... D21F 7/04 100/173
3,839,146 A * 10/1974 Fleissner ..... D04H 1/64 162/207
3,999,696 A * 12/1976 Reba ..... B29C 43/22 226/7
4,014,487 A * 3/1977 Reba ..... B29C 43/22 226/5
4,050,642 A * 9/1977 Katsumata ..... B65H 23/24 226/95
4,113,557 A * 9/1978 Kankaanpaa ..... D21F 2/00 162/301
4,192,711 A * 3/1980 Tapio ..... D21F 2/00 162/199
4,224,104 A * 9/1980 Kankaanpaa ..... D21F 2/00 162/205
4,501,643 A * 2/1985 Kiuru ..... B26F 3/02 162/193
4,551,203 A * 11/1985 Eskelinen ..... D21F 2/00 162/202
4,692,215 A * 9/1987 Kerttula ..... D21G 9/0072 162/193
4,815,220 A * 3/1989 Wedel ..... D21F 2/00 34/113
4,875,976 A * 10/1989 Wedel ..... D21G 9/0063 162/306
4,918,836 A * 4/1990 Wedel ..... D21F 5/04 162/193
4,923,567 A * 5/1990 Liedes ..... D21G 9/0063 162/193
5,037,509 A * 8/1991 Wedel ..... D21G 9/0072 162/193
5,101,577 A * 4/1992 Wedel ..... D21F 5/04 34/114
5,337,490 A * 8/1994 Griffin ..... D21F 5/042 34/115
5,355,593 A * 10/1994 Kotitschke ..... B65H 20/10 34/117
5,404,653 A * 4/1995 Skaugen ..... D21F 5/04 34/117
5,503,716 A * 4/1996 Kivimaa ..... D21F 3/04 162/193
5,718,058 A * 2/1998 Atzinger ..... D21F 5/042 34/117
5,720,852 A * 2/1998 Virta ..... D21G 9/0063 162/193
5,738,760 A * 4/1998 Svanqvist ..... D21G 9/0063 162/193
5,761,778 A * 6/1998 Fleissner ..... D04H 1/46 28/104
5,762,759 A * 6/1998 Wedel ..... D21F 2/00 162/193
5,830,321 A * 11/1998 Lindsay ..... D21F 2/00 162/204
5,893,505 A * 4/1999 Mueller ..... D21F 5/042 226/97.3
6,327,948 B1 * 12/2001 Tuori ..... B26D 7/015 83/177
6,379,502 B1 * 4/2002 Satzger ..... B65H 19/265 162/193
6,419,217 B1 * 7/2002 Hartmann ..... B26D 9/00 198/369.2
6,454,903 B2 * 9/2002 Mohrsen ..... D21G 9/0063 162/193
7,001,487 B2 * 2/2006 Clarke ..... B65H 20/06 162/281
2002/0092637 A1 * 7/2002 Rouhiainen ..... D21G 9/0063 162/272
2002/0189775 A1 * 12/2002 Linden ..... B65H 18/02 162/198
2003/0111199 A1 * 6/2003 Clarke ..... B65H 20/06 162/193
2003/0124938 A1 * 7/2003 Zafiroglu ..... D04H 1/50 442/328
2003/0150577 A1 * 8/2003 Broom ..... D21G 9/0009 162/193
2008/0014814 A1 1/2008 Geel et al.
2016/0031667 A1 * 2/2016 Klerelid ..... B65H 20/06 162/111
2018/0002866 A1 * 1/2018 Latendorf ..... D21F 2/00

FOREIGN PATENT DOCUMENTS

DE 9109313.9 U1 7/1991
DE 101 15 618 A1 3/2001
DE 102015001008 A1 * 7/2016 ..... D21F 2/00
EP 0819792 A1 1/1998
EP 2058433 A2 * 5/2009 ..... D21G 9/0063
WO WO 2011/157890 A1 12/2011
WO WO 2015/000687 A1 1/2015

OTHER PUBLICATIONS

German Examination Report corresponding to German Application No. 10 2015 001 008.5 dated Sep. 18, 2015, six pages.
International Search Report and Written Opinion corresponding to PCT/EP2016/000138, dated Apr. 8, 2016.
Search Report dated Sep. 17, 2018 for Chinese Patent Application No. 20160007524.0, all pages.

* cited by examiner

METHOD AND DEVICE FOR MAKING WET LAID NON WOVENS

The invention relates to a method and to a device for making wet laid non wovens.

It is known from DE 24 37 611 A1 that in the case of methods and devices for making wet laid non wovens the non woven that is formed on the wire upon having been removed from the wire is either guided in a free transfer to the subsequent unit, or in the case of the so-called closed transfer, is removed from the wire by way of a felt-wrapped roller, whereupon the web is transferred to the subsequent unit on the lower side of this pick-up felt.

Both types of transfer have disadvantages. Transferring the non woven to the subsequent treatment unit or onto a transportation belt in a free transfer has the disadvantage that the non woven web must have a significant initial wet strength in order to sustain the removing from the wire cloth and the free transfer up to the subsequent unit without rupturing. Even when the web does not rupture, the web, as a result of the latter adhering to the wire cloth, in the removal from the wire is exposed to substantial tensile stresses, on account of which stresses in terms of elongation that have to be equalized by modifying the speed of the subsequent units arise.

The closed transfer with the aid of a pick-up felt requires good adhesion of the non woven web to the lower side of the felt while the former is running. To this end, the pick-up felt must have an adequate moisture content. Moreover, the non woven web according to experience must comprise a significant proportion of cellulose and have paper-like characteristics, because the adhesion in the case of inadequate moisture in the pick-up felt is substandard such the non woven web is released from the pick-up felt and causes operational malfunctions.

In order for these disadvantages to be avoided, it is provided according to DE 24 37 611 A1 that the non woven web that is laid down on an inclined wire in a suspension sump and is dewatered by suction boxes below the wire runs from this wire directly, without the intervention of intermediate elements, onto a dryer surface that is located below the wire. However, such a solution is not suitable when the non woven web prior to drying is to be solidified, for example by means of hydroentanglement, or by means of the application of a binding agent.

To this extent, a further attempt in terms of a solution is in avoiding free transfers by compromises in the disposal of the machine components, for example on top of one another.

In the production of wet non wovens, water is used for forming fibers to a planar structure or to a wet non woven, respectively. The fibers in the water herein are guided over a wire. While the water is suctioned through the wire, the fibers are deposited on the wire. This process stage is referred to as the sheet formation. Depending on the type of the fiber, the non woven upon sheet formation still contains significantly more water than fibers. Water continues to be extracted from the non woven by way of vacuum heads, but the web at the junction that follows the wire and is usually formed by an inclined wire former is nevertheless not a stable product but a loose fiber composite.

For the reasons set forth, it is therefore advantageous to start at the full speed of the former. The required web consistency for producing a fiber composite that has an adequate inherent strength in order to be transferred to the next conveyor belt, or to the next treatment unit, or to the next machine component, respectively, can only be generated when the former operates at full speed. As has already been explained above, free transfers between the treatment units were commonplace in the case of low production speeds. For safety reasons, said free transfers are no longer possible as production speeds have increased, in particular not for the web feeding.

Proceeding from this prior art, the subject matter of the present invention is based on the object of providing a method and a device for making wet non wovens, said method and device improving the web feed at the production start and/or upon a production interruption.

This object is achieved by the claimed features.

It is achieved on account thereof, that for the production of wet laid non wovens and while using a wire installation the required treatment units/machine components can be disposed sequentially in known manner. Free transfers are provided between the wire installation and the at least one subsequent treatment unit. This is advantageous in particular when all treatment units/machine components for an operating mode that is optimized in terms of economy and energy are to be equipped with dissimilar wire belts. This is the case in particular, for example, when the production of a wet laid non woven comprises an inclined wire former, a hydroentanglement installation, and a dewatering belt. The junction that is provided between these treatment units as far as possible should not compromise one another such that free transfers to this extent are advantageous.

High production speeds are demanded of modern inclined wire former, on the one hand; on the other hand, there are safety guidelines that rule out the operators intervening in the machine. Since the product is fed onto inclined wire production lines at full production speed, an automated solution is possible therefor according to the invention.

According to the invention, the temporarily closed transfers offer the possibility of permitting free transfers between the treatment units/machine components, on the one hand, and of assigning the temporarily closed transfers to an automated solution, on the other hand, in order for the non woven web to be able to be fed at comparatively high machine speeds.

It is advantageously utilized that the wet non wovens that are generated on a wire device, in particular when long fibers are used, have an adequate strength in order to be released from the wire of the wire device by compressed air.

It is therefore provided according to the invention for a web feeding device which is configured as a temporarily closed transfer to be provided at the junctions between the wire installation and a subsequent treatment unit, or at junctions between two neighboring treatment units, respectively. An end feeding strip of the non woven web that at the exit end of a wire belt of the wire installation is cut from the running web is acquired by the temporarily closed transfer. This strip by way of air flows of the temporarily closed transfer is transferred to the respective subsequent treatment unit. The same applies to the junctions between two respective neighboring treatment units, for example between the wire belt of a hydroentanglement unit and a downstream dewatering belt.

It is furthermore provided that the cut end feeding strip is lifted from the wire, so as to be transferred by compressed air to a transportation installation, for example. Using an air flow, this tape is caught by the subsequent treatment unit such that the transfer of the end feeding strip that is achieved forms a temporarily closed transfer. Essential herein are preferably controlled raising, transferring, and subsequent controlled picking up.

Further embodiments of the invention are to be derived from the description hereunder and from the dependent claims.

The invention will be explained in more detail hereunder by means of the exemplary embodiment that is illustrated in the appended drawings.

Figure 1B:
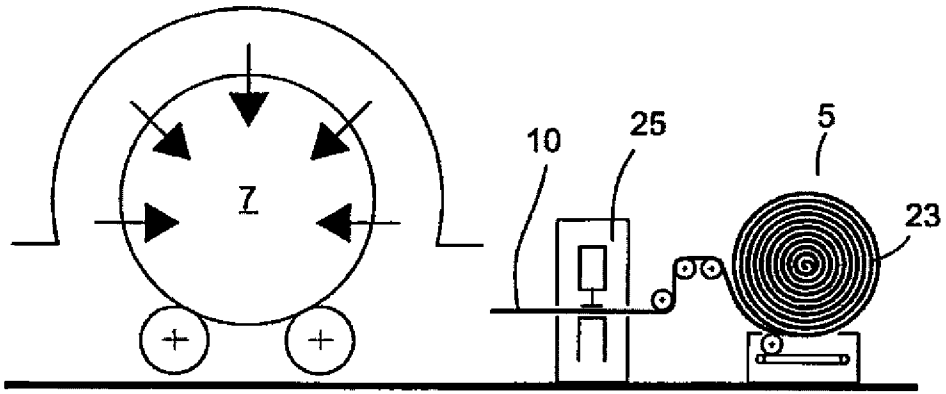
Figure 2:
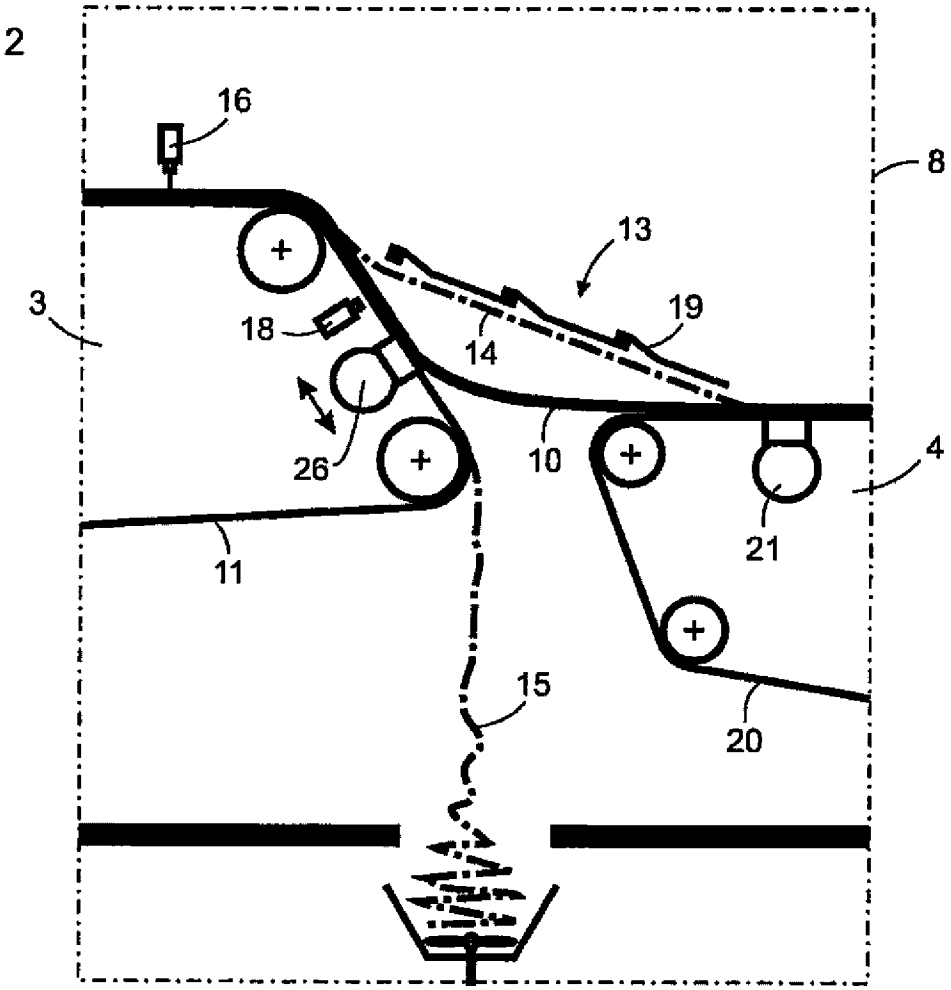

FIG. 1*a* schematically shows a side view of a wet non wovens plant having a free suspension installation, a wire installation, a hydroentanglement installation, and a dewatering belt;

FIG. 1*b* schematically shows the end sections of a wet non wovens plant, having a dryer and a winder;

FIG. 2 in an enlarged and schematic manner shows an exemplary embodiment of a web feeder for the junctions X, Y according to FIG. 1*a;*

Figure 3:
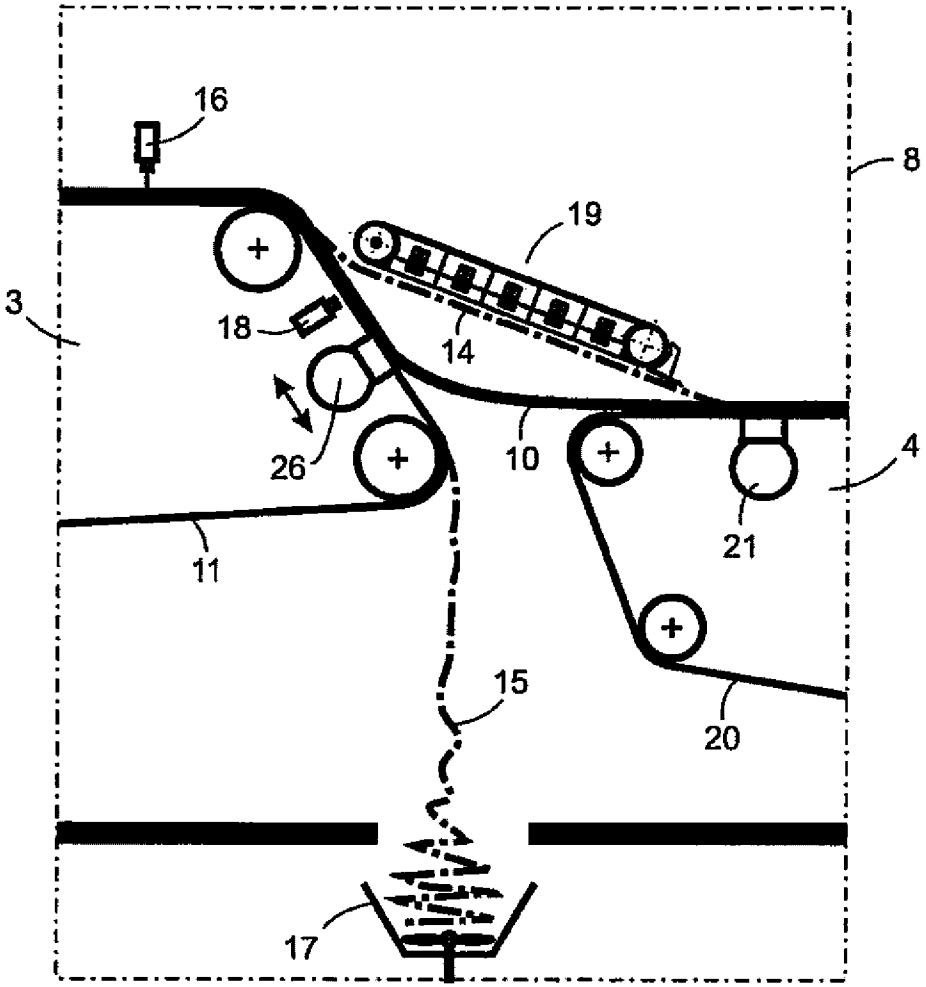

FIG. 3 shows a second exemplary embodiment of a web feed for the junctions X, Y according to FIG. 1*a;*

Figure 4:
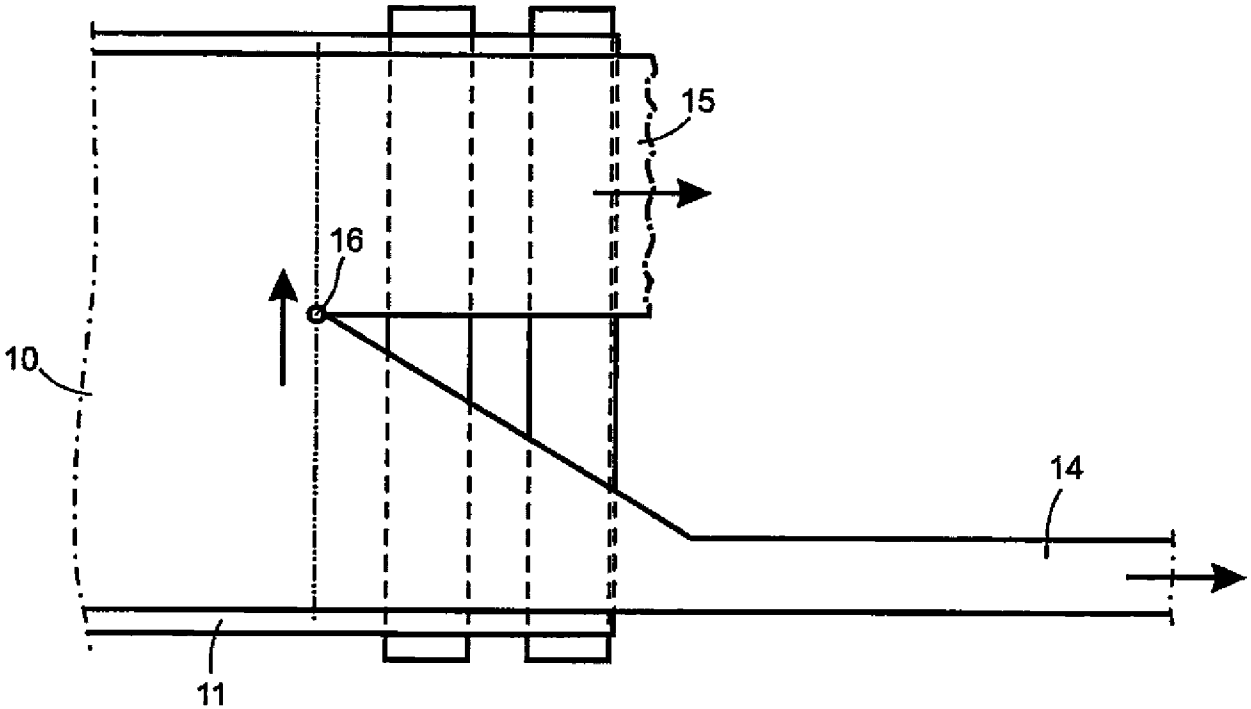

FIG. 4 schematically shows a plan view of the exit side end region of the wire installation in the region of the junction X according to FIG. 1*a*.

The invention relates to a method and to a device for making wet laid non wovens. A wet non wovens plant 1 that is provided in an exemplary manner to this end is illustrated in FIG. 1*a* and FIG. 1*b*.

Accordingly, a fiber suspension installation 2, a wire installation 3, at least one subsequent treatment unit 4, and optionally a winder 5 are sequentially disposed. A hydroentanglement installation is provided as the at least one treatment unit 4 in the case of the wet non wovens plant 1 illustrated in FIG. 1*a* and FIG. 1*b*. Further treatment units 6, 7 are furthermore provided. The treatment unit 6 is a drying wire, for example, and the treatment unit 7 is a dryer, for example.

The wire installation 3 is illustrated as an inclined wire former. Alternative configurations of the wire installation 3 can be used. A junction 8 is provided between the wire device 3 and the subsequent treatment unit 4. For example, a junction 9 is provided between the treatment unit 4 and the treatment unit 6. When the non woven web 10 is fed, both junctions 8, 9 are configured as free transfers.

In the case of a production start, or upon a production interruption, it is necessary for the non woven web 10 to be fed in order for the spacing in the region of the junctions 8, 9 to be overcome.

It has been established according to the invention that the non woven web 10 produced with wet non woven products on an inclined wire machine such as is illustrated in an exemplary manner as a wire installation 3 in FIG. 1*a* has an adequate strength in order for the material to be taken from the wire 11 by blowing. This is highlighted in FIGS. 2 and 3 in conjunction with FIG. 4.

The method according to the invention for making wet laid non wovens provides that an aqueous suspension having fibers is deposited onto a wire 11 of the wire installation 3 for the formation of a sheet of a non woven web 10 that is removed from the wire 11 and is dewatered by suction boxes 12 under the wire and, prior to the non woven web 10 being finally windable onto a roll 23, is infed to at least one subsequent treatment unit 4.

The non woven web in the case of a production start and/or upon a production interruption from the wire 11 to the at least one subsequent treatment unit 4 and/or at a junction 9 between two treatment units 4, 6 is transferred with the aid of a web feeding 13.

Referring to FIG. 2 to FIG. 4, web feeding 13 is performed by way of a transfer that in each case is temporarily closed and is part of a transfer that is free per se between the wire 11 and the at least one following treatment unit 4 and/or of a free transfer at a junction 9 between treatment units 4, 6.

The transfer that in each case is temporarily closed of a web feed 13 is generated by way of air flows. These air flows act on an end feeding strip 14 which is cut by means of a cutting installation 16 which acts on the non woven web 10 at the exit side of the wire 11. The end feeding strip 14 is severed from the remaining web 15 of the non woven web 10 by means of the cutting installation 16. Web feeding is performed by way of the end feeding strip 14, while the remaining web 15 drops into a pulper 17.

According to the invention, the end feeding strip 14 as part of the running non woven web 10 is lifted from the wire 11 by blowing by means of a compressed air installation 18. The end feeding strip 14, on account of negative pressure being generated on a transportation path installation 19, is attached to a transportation path that is formed by the transportation path installation 19 and is picked up by suctioning on the respective subsequent treatment unit 4. Suctioning on the subsequent treatment unit 4 is performed by means of a vacuum catching device 21, for example.

The explanations pertaining to the web feeding 13 at the junction 8 apply in an analogous manner to the web feeding 13 at the junction 9.

It has been established according to the invention that wet non woven products have an adequate strength when the latter have been dewatered on a wire installation 3 which is configured as an inclined wire machine, for example. This applies in particular also when long fibers are used for producing the non woven web. On account of this strength of the non woven web as produced by the wire installation 3, the wire web for web feeding can be released from the wire 11 by compressed air from the compressed air installation 18. The end feeding strip 14 that is raised from the wire 11 has sufficient stability in order to be transferred to the transportation path installation 19 by compressed air. The transportation path installation 19 in FIG. 2 is illustrated as an air baffle. The transportation path installation 19 in FIG. 3 is configured as a vacuum conveyor belt. By virtue of the air flows that exist, both transportation path installations 19 of FIG. 2 and FIG. 3 form negative pressure preferably on the lower side of the transportation path installation 19. On account thereof, it is possible for the raised end feeding strip 14 that is guided by way of the compressed air of the compressed air installation 18 to be moved to the subsequent treatment unit 4. The end feeding strip 14 is picked up by the vacuum catching installation 21 on a wire belt 20 of the subsequent treatment unit 4.

The transfer of the end feeding strip 14 thus achieved represents a temporarily closed transfer. To this extent, it is essential that controlled raising, transferring, and subsequent controlled picking up is possible on account of the configuration according to the invention.

As is illustrated in FIG. 1*a*, the treatment unit 4 is a hydroentanglement unit, for example. The end feeding strip 14 can be further stabilized by way of such hydroentanglement. On the free transfer subsequent to this hydroentanglement, at the junction 9, the transfer of the end feeding strip can again be raised from the wire belt 20 of the treatment unit 4 by compressed air and, based on the same principle, by way of a transportation installation 19 that generates negative pressure can be transferred to a next wire belt 22 of a subsequent treatment unit 6. According to FIG. 1*a*, this further treatment unit 6 is a vacuum dewatering unit, for example.

The end feeding strip 14 after the wire belt 22 of such vacuum dewatering is most often sufficiently stable in order to be able to be introduced into a rope cutter. Raising can again be performed by way of the wire belt by compressed air. The end feeding strip 14 can be caught by an air baffle or a further wire belt and be transferred to a rope cutter. The transfer of the end feeding strip 14 as described by way of the temporarily closed transfer can be readily carried out at production speeds between 200 and 250 m/min and more.

Once the end feeding strip 14 has been guided through the dryer, for example the treatment unit 7, and a quality assurance unit 25 up to the winder 5, the non woven web 10 on the wire installation 3 can be run at the full product width. After the wire installation 3, the wet non woven herein is sufficiently stable in order to be guided also by way of the entire product width directly by way of a free transfer to the next treatment unit.

In the case of the production speeds just mentioned, any change in the raising of the non woven web can rapidly lead to web ruptures. Therefore, a variable vacuum suction box 26 that is displaceable along the wire belt 11 is preferably fitted below the wire belt 11 of the wire installation 3. Once the non woven web runs at full width on the production line, the position of the product web lift can be defined with this vacuum suction box 26 precisely by way of an adjustment of the vacuum suction box 26, on the one hand, and of the setting of the vacuum, on the other hand. The free transfer between the vacuum suction box 26 of the wire installation 3 and the vacuum catching installation 21 of the subsequent treatment unit 4 can thus be defined in a precise manner. Unequal raising of the product web is prevented. The product web tension between the two wire belts 11, 20 is preferably controlled by way of a slack regulator. The same explanations apply to the junction 9 between two treatment units 4, 6.

According to the invention, the non woven web can be transferred in a more cost-effective manner as compared to conventional solutions, and the controlled free transfer moreover offers a cost-effective solution for guiding a product web.

The aforementioned slack control can be complemented by a control device for controlling lifting, transferring, and picking up an end feeding strip 14 at the junctions 8, 9 having a web feeding 13.

The invention claimed is:

1. A device comprising a wet non wovens plant having a fiber suspension installation at a beginning of the wet non wovens plant, a wire installation downstream of the fiber suspension installation to carry a non woven web, the wire installation having a cutting installation thereon to cut an end of the non woven web into an end feeding strip, at least one subsequent treatment unit positioned downstream of the wire installation, and having at least one free transfer at a junction between the wire installation and the subsequent treatment unit and/or at a junction between two subsequent treatment units, the at least one free transfer being temporarily closed for the end feeding strip by way of air flow installations of a web feeding installation, said air flow installations being positioned in such a manner that the end feeding strip as part of the running non woven web is removed at one side of the free transfer by a compressed-air installation, is subsequently transferred by a transportation path installation that generates negative pressure, and is afterwards picked up by an air suction installation of the subsequent treatment unit and wherein at least one of the subsequent treatment units is a hydoentanglement installation.

2. The device as claimed in claim 1, wherein the compressed-air installation is positioned adjacent the free transfer and lifts the non woven web from the wire installation by blowing compressed air at an underside of the non woven web.

3. The device as claimed in claim 1, wherein the transportation path installation that generated negative pressure are configured as a vacuum conveyor belt or as an air baffle installation.

4. The device as claimed in claim 1, wherein the transportation path installation has a lower side that is configured as a suction face.

5. The device as claimed in claim 1, wherein in order for a transferred end feeding strip to be picked up, the subsequent treatment unit on the entry side has a suction trap installation which is connected to a controller installation for controlling lifting, transferring, and picking up of an end feeding strip in the temporarily closed transfer.

* * * * *